United States Patent [19]

Long

[11] 3,970,055

[45] July 20, 1976

[54] UNIFLOW-TYPE EXTERNAL COMBUSTION ENGINE FEATURING DOUBLE EXPANSION AND ROTARY DRIVE

[76] Inventor: Otto V. Long, 3440 SW. Veterans Hospital Road, Portland, Oreg. 97201

[22] Filed: May 17, 1974

[21] Appl. No.: 470,820

[52] U.S. Cl. ..... 123/43 A; 60/39.61; 91/152

[51] Int. Cl.[2] ..... F02B 57/06

[58] Field of Search ..... 123/43 A, 43 R; 60/39.61, 461, 472; 91/502, 160, 164; 418/215

[56] References Cited

UNITED STATES PATENTS

| | | | |
|---|---|---|---|
| 1,277,964 | 9/1918 | Lovelace | 123/43 A |
| 1,293,080 | 2/1919 | Gilman | 91/152 |
| 1,807,087 | 5/1931 | Finke | 123/43 A |
| 1,880,224 | 10/1932 | Wilsey | 123/43 A |
| 2,115,556 | 4/1938 | Maniscaleo | 91/152 X |
| 3,695,237 | 10/1972 | Londo | 123/43 A |

FOREIGN PATENTS OR APPLICATIONS

| | | | |
|---|---|---|---|
| 2,914 | 2/1914 | United Kingdom | 123/43 A |
| 557,736 | 11/1943 | United Kingdom | 123/43 A |
| 204,440 | 10/1923 | United Kingdom | 123/43 A |

*Primary Examiner*—Clarence R. Gordon
*Attorney, Agent, or Firm*—Chernoff & Vilhauer

[57] ABSTRACT

An external combustion engine system adapted to utilize any of a number of expansible gases including steam, freon, thiophene, etc. The engine comprises a piston-driven unit which utilizes uniflow principles but is substantially more efficient than the conventional uniflow design because it provides means for conducting the exhaust from a primary side of the piston to a secondary side and thereby extracts additional energy from each gas charge through a second expansion before finally exhausting the gas to vacuum. In addition, the engine has a highly efficient and compact rotary design featuring a multi-cylinder barrel acting on a rotary torque conversion plate for minimizing friction and other energy losses. The design includes special valving for power and direction control and a simplified porting system for providing the aforementioned double gas expansion and permitting cold start-up without the need for bleed valves to drain condensate from the cylinders.

13 Claims, 2 Drawing Figures

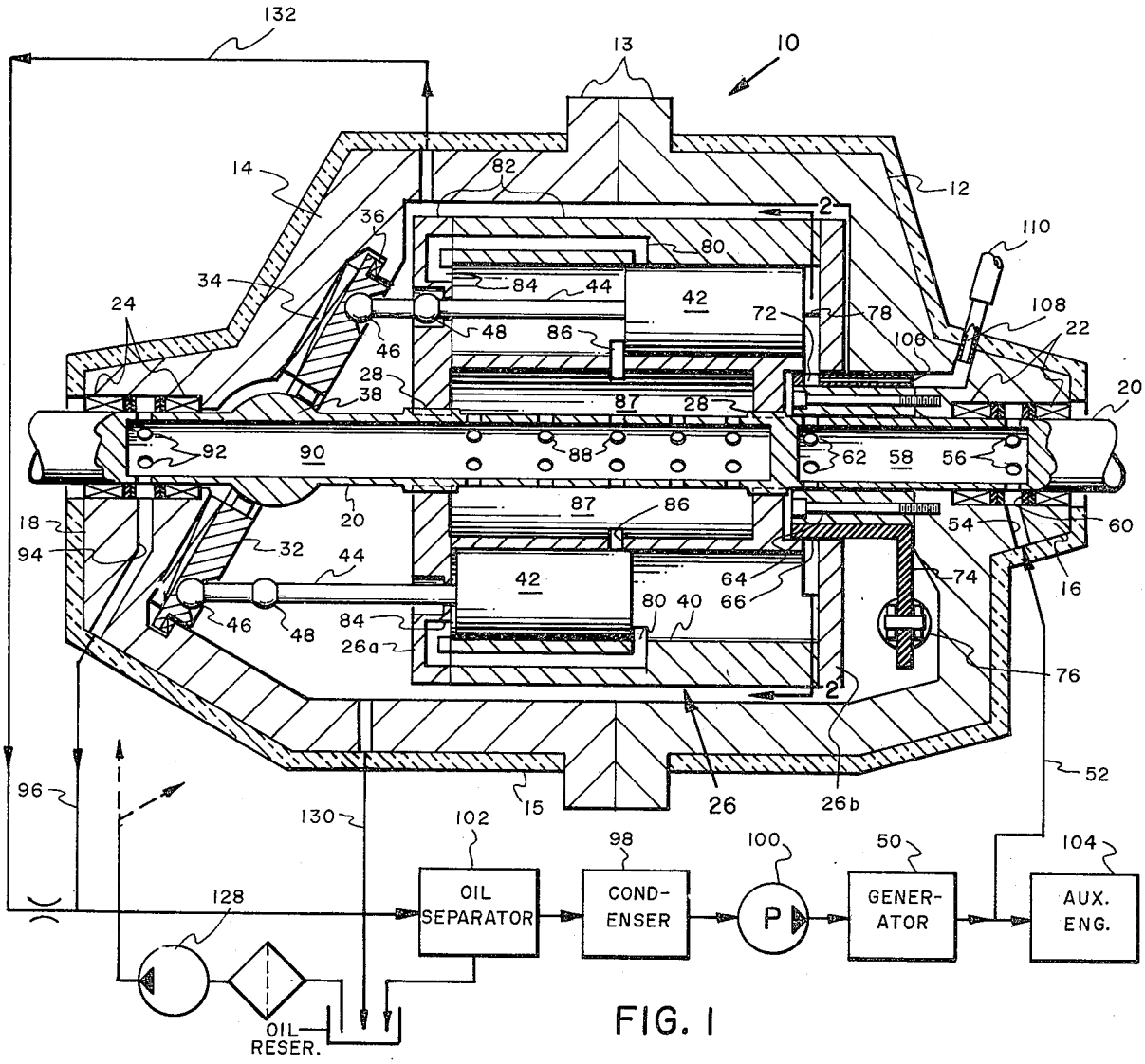
FIG. 1
FIG. 2
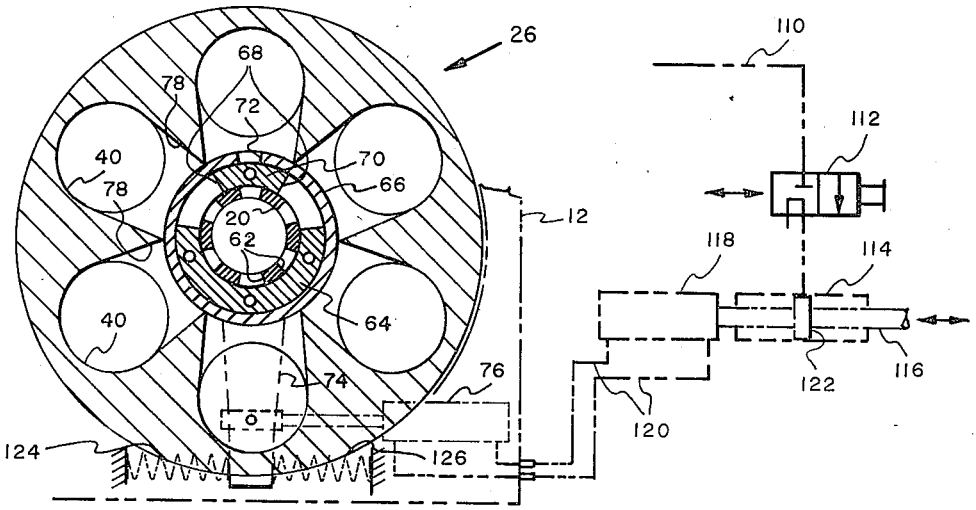

UNIFLOW-TYPE EXTERNAL COMBUSTION ENGINE FEATURING DOUBLE EXPANSION AND ROTARY DRIVE

BACKGROUND OF THE INVENTION

This invention relates to improvements in external combustion engine systems of the type which generate power by the expansion of a non-burning gas. More particularly the invention relates to improvements in a uniflow-type piston-driven engine for increasing the thermal efficiency thereof.

The increasing demand for pollution-free automobile engines and other power plants, and the more recent awareness of gasoline shortages, have both indicated a strong need for replacement of the internal combustion engine. The steam engine, able to capitalize on the low emission advantages of external combustion and the simplified mechanics and drive train made possible by high starting torque and a reversible engine, is one very likely successor. Other possibilities include external combustion engines utilizing freon ($CCl_2F_2$), thiophene [$(CH)_4S$] or other similar elastic fluids. In any automobile engine, it would appear that pistons must be utilized rather than turbines, since turbines require very high volumes, lack low speed torque and work best at relatively constant high speeds, thereby requiring substantial gear reduction.

One disadvantage, at least until now, of the external combustion piston engine (or expansion engine), is that it has lacked sufficient thermal efficiency to make it a practical alternative for automotive use, although it is virtually emission-free and is capable of using kerosene or cheap grades of fuel oil. Probably the most significant development in recent years with respect to improving the efficiency of external combustion piston engines has been the development of the "uniflow" principle of exhaust valving, primarily applied to steam engines, whereby the exhaust is arranged so that the steam or other expansible fluid flows from the end of the cylinder to exhaust ports located near the center, and does not reverse its direction of flow during exhaust as is the case with older types of external combustion engines. This elimination of exhaust flow through inlet ports was important because it substantially eliminated a particular type of energy loss known to those skilled in the art as "initial condensation", thereby markedly improving the efficiency of the engine. Despite the improved efficiency of the uniflow-type engine, however, great energy losses still exist. One of the most significant of these is the energy loss resulting from incomplete expansion of the steam or other gas admitted into the cylinder caused by the release of the gas from the engine at the end of the stroke at too high a pressure. Not only does such incomplete expansion tend to decrease the amount of usable energy which can be extracted from the gas, but it also places a greater load on the condenser in a recycling system since the returning gas is at a relatively higher energy level and the size and power requirements of the condenser and its associated blower must also be proportionately greater. Other substantial causes of energy loss are friction and the inertia and leverage inefficiencies of the standard crankshaft drive system used in conventional engines. Friction losses are particularly aggravated by the crankshaft design because the connecting rod necessarily transmits driving force at considerable angles between the piston and the crank, thereby tending to cock the piston alternately in either of two directions against the cylinder wall as it reciprocates and causing increased friction. The lack of any substantially straight-line force transmission through the connecting rod and the resultant loss of torque also substantially hinders the efficiency of present external combustion piston engines.

SUMMARY OF THE PRESENT INVENTION

The present invention is directed to an inexpensive, durable and compact external combustion engine of the piston type which includes unique features designed to minimize the aforementioned energy losses from incomplete expansion, friction and crankshaft inefficiency and thereby provide an engine which is not only virtually pollution-free but which also has a higher thermal efficiency than previous piston-type external combustion engines. The engine comprises a housing having a drive shaft running longitudinally thrugh the housing and emerging at either end, such shaft being especially well adapted to be drivingly interposed between rear and/or front wheels of an automobile but also being adapted for connection to other power transmission means if desired. Inside the housing and splined to the shaft so as to rotate therewith is a cylinder block having a plurality of pistons mounted therein for reciprocation in a direction parallel to the drive shaft. Adjacent one end of the block a torque transmission plate is mounted within the housing so as to rotate about an axis which is tilted with respect to the drive shaft, such plate being attached to the drive shaft by a constant velocity universal joint so as to rotate therewith. Piston rods protrude from the cylinder block in a direction parallel to the drive shaft toward the tilt plate, each being universally connected to the plate by a pair of ball joints. As the pistons reciprocate, the piston rods transmit substantially straight-line force against the torque conversion plate and cause the cylinder block, plate and drive shaft to rotate in unison.

A pressurized expansible gas from a suitable generator is introduced by a variable power and direction control valve to a primary side of each respective piston and is exhausted near the center of the cylinder upon completion of a stroke, as in the conventional uniflow design. However, rather than exhausting to atmosphere or to a condenser for recycling, such exhaust is coupled by a transfer manifold to the opposite or secondary side of the same piston so that the exhausted gas may be further expanded usefully on the return stroke of the piston. An exhaust port, also located adjacent the center of the cylinder, finally exhausts the gas from the secondary side upon completion of the return stroke and conducts it to a vacuum chamber inside the cylinder block, through a vacuumized passageway in the drive shaft to the outside of the housing and thence to a condenser for recycling, while simultaneously imposing a vacuum on the secondary side which helps to provide power. The inlet porting and transfer manifold are arranged such that both the primary and secondary sides of each piston are inherently provided with a reservoir which provides an escape for condensed fluid when the engine is cold, thereby permitting the engine to be run cold without necessitating cylinder head bleed valves to drain the condensate prior to starting. An optional governor arrangement is provided which senses piston pressure and automatically controls the power valve setting in response to the load on the engine.

It is accordingly a primary objective of the present invention to provide an engine of the uniflow piston type which provides for double expansion of each pressurized gas charge by permitting such charge to be exhausted from one side of a respective piston to the opposite side thereof to be further expanded on the return stroke before being finally exhausted from the system, thereby minimizing energy losses resulting from incomplete expansion and thereby improving the thermal efficiency of the engine.

It is a further objective of the present invention to provide an external combustion engine of the piston type which features expansion chambers on both sides of the piston and utilizes no crank shaft but rather utilizes a more efficient rotary torque conversion plate drive constructed so as to reduce friction and other drive train energy losses.

It is a further objective of the present invention to provide such an engine with simplified porting and controls for introducing and exhausting an expansible gas and enabling the engine to be produced in a compact and inexpensive form.

It is a further objective of the present invention to provide means for permitting the escape of condensate at either end of the piston so as to permit the engine to be operated cold without necessitating cylinder head bleed valves.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a sectional side view of the engine with its associated gas generation and accessory system shown schematically.

FIG. 2 is a sectional view of the cylinder block and the power and directional control valve taken along line 2—2 of FIG. 1, showing an exemplary throttle control linkage schematically.

DESCRIPTION OF THE PREFERRED EMBODIMENT

The external combustion engine of the present invention, designated generally as 10 in FIG. 1, comprises a housing composed of two halves 12 and 14 respectively which are detachably joined together at flanges 13 by bolts or other conventional fastening means (not shown). Thermal insulation 15 surrounds the housing to minimize heat loss. Each half of the housing 12 and 14 includes a respective journal casing 16, 18 longitudinally aligned with one another when the housing is assembled so as to mount a rotatable drive shaft 20. The drive shaft is journaled in suitable bearings 22, 24 so as to prevent any longitudinal movement of the shaft with respect to the engine housing and extends from either end of the housing for attachment to the driven load, which may be automobile wheels or other mechanisms as desired. Power transmissions or other gearing may be connected to the drive shaft 20 but normally need not be since the engine is inherently reversible, has high torque regardless of engine speed, even when stalled, and does not "idle", which characteristics are all very different from those of internal combustion engines.

A drum-shaped cylinder block 26 having a pair of detachable heads 26*a*, *b* is mounted within the housing supported by the drive shaft 20 which passes through the longitudinal axis of the block. Splines 28 fix the cylinder block 26 to the shaft 20 so that the two rotate in unison. The tight fit of the splined connection prevents any longitudinal movement between the cylinder block and the shaft. Adjacent one end of the cylinder block, a circular torque transmission plate 32 is mounted to the housing by bearings 34, 36 so as to rotate about an axis which is tilted with respect to the axis of the drive shaft 20. The plate 32 is attached to the drive shaft 20 by a constant velocity universal joint 38 so that the two rotate together.

Inside the cylinder block 26 a plurality of cylinders 40 are formed with their longitudinal axes parallel to the axis of the drive shaft 20. Preferably six such cylinders are equally spaced radially about the longitudinal axis of the drive shaft and cylinder block, although other numbers of cylinders could be used. Each cylinder includes a longitudinally reciprocating piston 42, the cylinder block defining a gas expansion chamber on either side of each piston. A piston rod 44 extends from each piston through the end of the cylinder block 26 where it is connected to the torque conversion plate 32 by a ball joint 46 for universal movement. The ball joints 46 enable both tension and compression forces to be exerted between the rods 44 and the plate 32. Each rod 44 is articulated at a point intermediate its length by a second ball joint 48 to compensate for the fact that the path of travel of the joints 46 when viewed in a plane perpendicular to the axis of the drive shaft is elliptical rather than circular. The bearings 34, 36 which retain the plate 32 in its tilted position also provide resistance for both the push and the pull which may be exerted between the respective rods 44 and the plate 32.

It will thus be apparent to those skilled in the art that if an imaginary vertical plane is passed through the longitudinal axis of the drive shaft 20, and if all pistons to one side of such plane are made to exert a greater thrusting force against the circular plate 32 than is exerted by pistons on the opposite side of such plane, the cylinder block, plate and drive shaft will all turn together in unison pursuant to the power developed in the pistons, the direction of rotation being dependent upon which side of the imaginary vertical plane has the greater pushing force. For example, with reference to FIG. 2, if the pistons on the right-hand side of the imaginary vertical plane exert the greater pushing force the cylinder block 26, plate 32 and drive shaft 20 will rotate in a clockwise directon. Conversely, if the pistons on the left-hand side of the plane exert the greater pushing force, the engine will rotate in a counterclockwise direction. It should be noted that the piston rod force exerted on the plate 32 for developing the moving torque is always substantially in the direction of reciprocation of the piston, without the large angular changes inherent in conventional crankshaft designs, and this minimizes the forces which tend to cock the piston to one side or the other and thereby greatly minimizes the frictional forces and resultant energy losses between the piston and the cylinder wall while maximizing torque by the substantially straingt-line force transmission path.

In operation, pressurized gas is fed from any suitable compact generator 50, such as a steam or freon boiler, through a conduit 52 to a port 54 formed in the journal casing 16. The port 54 communicates through a series of apertures 56 in the drive shaft 20 with an interior drive shaft passageway 58. Seals such as 60 isolate the incoming pressurized gas from the bearings 22. (Alternatively the gas could be admitted similarly through a yoke surrounding the drive shaft 20 at a location remote from the bearings.) The pressurized gas passes through the interior passageway 58 to a second series of drive shaft apertures 62. The apertures 62 communicate with an annular portion 64 of the housing section 12 which closely surrounds the drive shaft 20 and is in turn surrounded by a rotatable power control valve sleeve 66 and the primary end of the cylinder block 26. As seen in FIG. 2, the annular portion 64 has two radial ports 68 extending therethrough in transverse alignment with the drive shaft apertures 62, each port 68 being of sufficient width that a respective aperture 62 will always be in communication with each port 68 regardless of the rotational position of the drive shaft 20. Each of the ports 68 projects radially outwardly through the annular portion 64 of the housing in directions toward opposite sides of an imaginary vertical plane disposed longitudinally along the axis of the drive shaft 20. A solid section 70 of the annular portion 64 lies between the ports 68 in a position encompassing the vertical plane, thereby blocking the transmission of gas from the ports 62 in a vertical direction. The power control valve sleeve 66 which surrounds the annular portion 64 has a single port 72 formed therein in transverse alignment with the ports 68 and 62. The sleeve 66 is rotatable about the axis of the drive shaft and may be actuated to turn in one direction or the other by means of an arm 74 which extends from the sleeve. The control linkage which acts on the arm 74 is preferably a small hydraulic cylinder 76 mounted in the engine housing, although other linkages would also be suitable.

Each cylinder 40 in the cylinder block 26 has a respective admission port 78 which is transversely aligned with the ports 72, 68 and 62 respectively. The combination of the annular portion 64 and the rotatable valve sleeve 66 thereby comprises both a power control and directional control valve for the engine. When the sleeve 66 is in its center position, as shown in FIG. 2, no pressurized gas from the drive shaft ports 62 can pass to any of the cylinders because port 72 is blocked by the solid section 70, and therefore no motive power is developed by the engine. By actuating the hydraulic cylinder 76 to push the arm 74 in a clockwise direction, the port 72 moves to a position overlapping the right-hand port 68 of the annular portion 64 and permits pressurized gas to be admitted through a port 78 to the primary side of any piston occupying the upper right-hand side of the cylinder block, thereby causing such piston to exert a thrusting force against the torque conversion plate 32 and initiating clockwise rotation of the engine. Likewise, if the hydraulic cylinder 76 pulls the arm 74 counterclockwise from the center position, counterclockwise rotation of the engine is initiated. The relative amount of thermal energy delivered to the engine is regulated by the extent to which the sleeve 66 is rotated in one direction or the other from the center position. Such degree of rotation determines the degree of overlap between the respective ports 68 and the port 72, thereby defining a throttle which causes a variable pressure drop between generator pressure and the pressure of the gas admitted to the pistons. Other types of power and directional control valving, including those employing "cut-off" rather than throttling principles, could also be utilized and are within the scope of this invention.

Pressurized gas admitted to the primary side of a respective piston 42 situated in a substantially retracted condition, as it would be when located near the top of the cylinder block 26, immediately expands and pushes on the piston thereby causing engine rotation. Just before the piston reaches the full extent of its stroke at the bottom of its circular path about the drive shaft axis, it uncovers a transfer port 80, of which there may be more than one if desired, located adjacent the center of the cylinder. The transfer port 80 communicates with a transfer manifold 82 which conducts partially expanded gas from the primary side of the piston to an inlet port 84 adjacent the opposite end of the cylinder communicating with the expansion chamber on the opposite or secondary side of the same piston. At the time the transfer is made, the gas is still at a relatively high energy level having undergone incomplete expansion on the primary side of the piston. Additional energy is therefore extracted from the gas as it undergoes a second expansion during the return stroke. Upon completion of the return stroke the piston uncovers an exhaust port or ports 86 also located adjacent the center of the cylinder but offset longitudinally from the first port 80 so that both ports cannot be uncovered at once. The exhaust port 86 communicates with a vacuum chamber 87 inside the cylinder block and thence through a set of apertures 88 with an interior passageway 90 in the drive shaft 20 separate from the first-mentioned interior passageway 58. The exhausted gas travels from the passageway 90 through a set of drive shaft apertures 92 and a port 94 in the journal casing 18 similar to the gas entry arrangement at the opposite end of the drive shaft. The exhausted gas passes through a vacuumized return line 96 to a condenser 98 from which it is recycled by a condensate pump 100 back to the generator 50. If the gas is laced with oil for lubrication, such as steam oil, it should first be passed through an oil separator 102 before returning to the condenser 98.

The additional expansion of each separate gas increment by means of the transfer of partially expanded gas from one side of the piston to the other upon the completion of a stroke operates to extract an appreciably greater amount of energy from the gas than could be obtained if the gas were not further expanded but were merely exhausted to the condenser from the primary side of the piston. Although the pressure level remaining on the primary side of the piston after completion of the stroke is higher as a result of exhausting to the opposite side of the piston, this does not detract from the overall thermal efficiency of the engine since, on the return stroke, the energy level of the residual gas left on the primary side will be at a higher level than would otherwise be the case and thus less energy input from new pressurized gas is required on the next succeeding primary stroke. Thus the thermal efficiency of the engine, i.e. energy output as a percentage of energy input, is improved markedly.

Although in the preferred embodiment the secondary side of the piston is shown as being the rod end, the porting could be reversed so that the primary side constitutes the rod end and the secondary side, to which the gas is transferred after the primary stroke, is the opposite end. Moreover in some designs, particularly where the engine need not be reversible, it might be satisfactory to exhaust from the primary side of one piston to the secondary side of a next adjacent piston in the cylinder block to achieve an improved steam or gas cycle diagram. Furthermore, the foregoing gas transfer feature could be applied also in an internal combustion engine where incomplete expansion is also a serious cause of thermal inefficiency.

The fact that the gas finally exhausted from the secondary side of the piston leaves at a considerably lower energy level than would otherwise be the case, due to a more complete expansion, imposes substantially less load on the condenser requiring less energy removal, less size and less power to drive associated blowers or fans. This factor also contributes to overall system efficiency and energy savings. A high condenser vacuum (about 15 inches of mercury) acting on the exhaust ports 86 is deemed preferable to enhance the power characteristics of the engine since such vacuum, with the aid of the vacuum chamber 87, insures the existence of a very low absolute pressure on the secondary side of the piston during the primary stroke.

The provision of gas admission ports 78 entering the primary sides of the respective cylinders transversely thereto causes the formation of condensate reservoirs external of the cylinders at the respective primary ends of the pistons, such reservoirs being defined by the respective ports 78 in the area between the valve sleeve 66 and cylinder wall. At the secondary ends of the pistons the transfer manifolds 82 define similar reservoirs. Such reservoirs provide a momentary escape from the cylinder for condensed residual gas which may form while the engine is shut down. Thus the engine 10 can be started cold, and such condensate will temporarily escape from the respective ends of the pistons to the aforesaid reservoirs on the initial compression strokes until it can be vaporized by incoming pressurized gas, thereby preventing harm to the engine by the presence of an incompressible fluid in the system. The provision of the reservoirs obviates the need for cylinder bleed valves to remove the condensate prior to starting the engine.

The engine 10 can be used for braking purposes, and for maximum braking the rotatable valve sleeve 66 may be turned in a direction opposite to engine rotation to utilize incoming gas pressure to resist motion.

It is deemed preferable, in an external combustion automotive vehicle, that accessories such as the electrical generator, power steering, air conditioning, condenser fan, condensate pump, etc. be driven by a power source other than the primary external combustion drive engine because such engine normally does not idle but is stalled when the vehicle is stopped, and also does not attain a high rpm at low vehicle speeds. Accordingly, it is preferable to have one or more auxiliary external combustion engines, shown schematically as 104 in FIG. 1, driven by the same gas generator 50 which drives the main drive engine 10. Aside from the fact that the battery would probably be insufficient to drive the various automotive accessories continuously when the main drive engine is stopped, the auxiliary external combustion engine or engines provide the additional advantage that they keep the pressurized gas generator 50 working at all times, even when the main drive engine is stalled. Without such a continuing load on the generator 50 it would be forced to shut down if the vehicle is stopped for any appreciable period of time and, unless a large gas reservoir is provided which is impractical in most automotive vehicles, there might be an insufficiency of pressurized gas once the vehicle is set in motion. The provision of one or more auxiliary external combustion engines 104 imposing a continuous load on the generator 50 independently of vehicle motion helps to alleviate this problem.

A governor may optionally be employed with the engine 10 of the present invention in the exemplary manner shown in FIGS. 1 and 2. The valve sleeve 66 includes a pilot port 106 in communication with the port 72 for sensing primary piston pressure. The pilot port 106 communicates through a passageway 108 with the outside of the engine housing, passing through a line 110 to a manual governor control valve 112 (FIG. 2). When the control valve 112 is moved to the right as shown in FIG. 2, the line 110 is blocked and the governor is inoperative. When the valve 112 is moved to the left, the line 110 communicates with a piston housing 114 through which the throttle linkage 116 passes. The throttle linkage 116 is preferably connected to an external hydraulic cylinder 118, which in turn operates the internal throttle control cylinder 76 through hydraulic feed lines 120 in response to the extension or retraction of the throttle linkage 116. A piston 122 is attached to the linkage 116 within the housing 114. When the line 110 is blocked by valve 112, no pressure is exerted on either side of the piston 122 and throttle control depends entirely upon other external forces exerted on the linkage 116. However when line 110 is not blocked, a pressure equal to the primary piston pressure is exerted on the piston 122, thereby tending to move the linkage 116 automatically one way or the other depending upon which direction has been initially selected. Primary piston pressure sensed through line 110 is proportional to the drive load imposed on the engine at any particular time, and acts against throttle control compression springs 124 or 126 (depending upon direction) tending automatically to open the throttle further as load on the engine increases. Conversely the springs tend to close the throttle as the load decreases. Thus, with the governor activated, the throttle is automatically responsive to engine torque loads and tends to maintain a constant rpm regardless of varying load.

The lubrication system for the various engine bearings and joints is conventional and is therefore not shown in detail. Oil is pumped from a central reservoir by a pump 128 to the various bearings and flows thereafter into the interior or the engine housing where it is drained back to the reservoir through a line such as 130. Since some pressurized gas from the cylinders is expected to leak through the piston rod seals to the interior of the housing, a slightly vacuumized vapor return line 132 is provided so that any such leakage will be returned to the condenser 98. It will be understood that various conventional seals, etc. are provided at appropriate locations in the engine but are not shown in detail since they form no part of the invention.

Although the use of steam laced with steam oil (or freon laced with silicones) is one conventional method which could be used to lubricate the pistons and cylinders, it is contemplated that a coating of "teflon" fluorocarbon resin on the pistons and cylinder walls would produce a lower coefficient of friction and thus further minimize energy losses.

The terms and expressions which have been employed in the foregoing abstract and specification are used therein as terms of description and not of limitation, it being understood that the invention is not confined to the particular preferred embodiment shown but may take other mechanical forms. Accordingly there is no intention of excluding equivalents of the features shown and described or portions thereof, it being recognized that the scope of the invention is defined and limited only by the claims which follow.

What is claimed is:

1. Engine apparatus of the type having at least one cylinder in which a piston reciprocates, said cylinder defining respective chambers located at first and second ends of said cylinder on either side of said piston, wherein the improvement comprises:

a. means defining an exhaust port in the wall of said cylinder adjacent the center thereof positioned so as to be exposed to the interior of said cylinder when said piston is adjacent the first end of said cylinder and blocked by said piston when said piston is adjacent the second end of said cylinder;

b. means defining a transfer port in the wall of said cylinder adjacent the center thereof separate from said exhaust port and positioned so as to be exposed to the interior of said cylinder when said piston is adjacent said second end and blocking said exhaust port;

c. means defining an inlet port in the wall of said cylinder adjacent said second end thereof and positioned so as to communicate with the interior of said cylinder when said piston is adjacent said second end and blocking said exhaust port; and d. means defining a transfer passageway joining said transfer port and said inlet port for selectively transferring gas from said chamber at said first end of said cylinder to said chamber at said second end of said cylinder when said piston is adjacent said second end and blocking said exhaust port.

2. The apparatus of claim 1 wherein said exhaust port and transfer port are offset with respect to one another longitudinally of said cylinder such that said exhaust port is nearer to said second end of said cylinder than said transfer port so as to permit said piston to block said exhaust port without simultaneously blocking said transfer port when said piston is adjacent the second end of said cylinder.

3. The apparatus of claim 1 including means defining a gas admission port in the wall of said cylinder adjacent the first end thereof.

4. A reciprocating piston-type engine comprising:

a. an engine housing;

b. a drive shaft extending longitudinally through said housing rotatably journaled thereto;

c. a drum-shaped cylinder block fastened coaxially about said drive shaft within said housing so as to rotate in unison therewith, said cylinder block defining a plurality of cylinders having longitudinal axes parallel with the axis of said drive shaft and spaced radially about said drive shaft;

d. a torque transmission plate universally attached to said drive shaft adjacent one end of said cylinder block so as to rotate about said shaft in unison with said shaft and cylinder block, said plate being tiltably journaled to said housing so as to rotate about an axis which is tilted with respect to the axis of said drive shaft;

e. a reciprocating piston within each of said cylinders, each having a piston rod protruding through said end of said cylinder block and universally attached to said torque transmission plate at a respective point spaced radially from the axis of rotation of said plate; and f. means in said cylinder block defining respective chambers on both sides of each said piston.

5. The apparatus of claim 4 wherein each said piston rod includes an articulated joint located intermediate said end of said cylinder block and said point of attachment of said rod to said torque transmission plate.

6. The apparatus of claim 4 wherein said drive shaft includes first passageway means extending longitudinally within said shaft for conducting gas from outside said engine housing to said respective cylinders for driving said pistons, and second passageway means extending longitudinally within said shaft separate from said first passageway means for receiving exhaust gases from said respective cylinders and conducting them to the exterior of said engine housing, said shaft including respective apertures extending between said respective passageway means and the perimeter of said shaft for conducting said gases into and out of said respective passageway means.

7. The apparatus of claim 6 wherein said first and second passageway means are spaced from one another longitudinally of said drive shaft and wherein a transverse wall is provided within said shaft for separating said respective passageway means.

8. The apparatus of claim 6 wherein each said cylinder includes means defining an exhaust port in the wall thereof adjacent the center of said cylinder and in communication with said second passageway means for exhausting gases from the interior of said cylinder to said second passageway means.

9. The apparatus of claim 8 wherein said cylinder block includes means defining an exhaust chamber interposed between and in communication with said respective exhaust ports and said second passageway means.

10. The apparatus of claim 6 including an annular portion surrounding said drive shaft adjacent said first passageway means and rigidly attached to said engine housing, said annular portion having a pair of radial ports extending therethrough in communication with said first passageway means, said pair of ports projecting in respective radial directions toward opposite sides of an imaginary plane defined by the axis of said drive shaft and the axis of rotation of said torque transmission plate, a valve sleeve rotatably mounted about said annular portion and having a port therethrough adapted to communicate selectively with one or the other of said radial ports depending upon the rotational position of said sleeve, control linkage means for controlling said rotational position of said sleeve, and means defining respective cylinder admission ports formed in the walls of said cylinders positioned so as to communicate selectively with said valve sleeve port depending upon the rotational position of said cylinder block.

11. The apparatus of claim 4 wherein each said cylinder includes means defining a transfer passageway for selectively transferring gas between said respective chambers on either side of a respective piston in response to the reciprocating position of said piston.

12. A method of driving an engine of the type having at least one cylinder in which a piston reciprocates, said cylinder defining respective chambers located at first and second ends of said cylinder on either side of said piston and having an exhaust port in the wall of said cylinder adjacent the center thereof, said method comprising:

a. injecting a pressurized gas charge through a gas admission port adjacent the first end of said cylinder while said piston is located adjacent said first end;

b. moving said piston toward the second end of said cylinder by expansion of said pressurized gas charge;

c. when said piston is adjacent the second end of said cylinder, transferring said gas charge to the second end of said cylinder through a transfer port in the wall of said cylinder adjacent the center thereof, while simultaneously blocking said exhaust port from communication with the interior of said cylinder;

d. thereafter moving said piston toward the first end of said cylinder; and e. when said piston is adjacent the first end, exposing said exhaust port to the interior of said cylinder and exhausting said gas charge through said exhaust port.

13. Engine apparatus of the type having a plurality of cylinders in each of which a piston reciprocates, each said cylinder defining respective chambers located at first and second ends of said cylinder on either side of said piston, wherein the improvement comprises:

a. means defining an exhaust port in the wall of each said cylinder adjacent the center thereof positioned so as to be exposed to the interior of said cylinder when said piston is adjacent the first end of said cylinder and blocked by said piston when said piston is adjacent the second end of said cylinder;

b. means defining a transfer port in the wall of each said cylinder adjacent the center thereof separate from said exhaust port and positioned so as to be exposed to the interior of said cylinder when said piston is adjacent said second end and blocking said exhaust port;

c. means defining an inlet port in the wall of each said cylinder adjacent the second end thereof and positioned so as to communicate with the interior of said cylinder when said piston is adjacent said second end and blocking said exhaust port; and d. means defining a transfer passageway joining a respective transfer port with a respective inlet port of said cylinders for selectively transferring gas from a chamber at the first end of one of said cylinders to a chamber at the second end of one of said cylinders when the exhaust port in the same cylinder as said transfer port is blocked.

* * * * *

UNITED STATES PATENT AND TRADEMARK OFFICE

CERTIFICATE OF CORRECTION

PATENT NO. : 3,970,055

DATED : July 20, 1976

INVENTOR(S) : Otto V. Long

It is certified that error appears in the above-identified patent and that said Letters Patent are hereby corrected as shown below:

Col. 4, Line 64 Change "straingt-line" to --straight-line--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*